US011466526B1

(12) United States Patent
Musso

(10) Patent No.: US 11,466,526 B1
(45) Date of Patent: Oct. 11, 2022

(54) POLYMERIC SLEEVE FOR GUIDING AN UNTETHERED MEASUREMENT DEVICE IN A CHRISTMAS TREE VALVE

(71) Applicant: SAUDI ARABIAN OIL COMPANY, Dhahran (SA)

(72) Inventor: Simone Musso, Houston, TX (US)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/399,758

(22) Filed: Aug. 11, 2021

(51) Int. Cl.

| | |
|---|---|
| ***E21B 23/00*** | (2006.01) |
| ***E21B 47/09*** | (2012.01) |
| ***E21B 17/10*** | (2006.01) |
| ***E21B 34/02*** | (2006.01) |
| ***E21B 49/08*** | (2006.01) |

(52) U.S. Cl.
CPC ..... *E21B 23/00* (2013.01); *E21B 17/10* (2013.01); *E21B 34/02* (2013.01); *E21B 47/09* (2013.01); *E21B 49/087* (2013.01)

(58) Field of Classification Search
CPC ..... E21B 23/00; E21B 17/10; E21B 34/02; E21B 47/09; E21B 49/087
See application file for complete search history.

(56) References Cited

U.S. PATENT DOCUMENTS

| | | | | |
|---|---|---|---|---|
| 6,241,028 | B1 * | 6/2001 | Bijleveld | E21B 47/00 175/40 |
| 8,048,348 | B2 | 11/2011 | Duan et al. | |
| 8,540,032 | B2 | 9/2013 | Nutley et al. | |
| 9,399,902 | B2 | 7/2016 | Greci | |
| 9,970,269 | B2 | 5/2018 | Lopez et al. | |
| 10,781,671 | B2 | 9/2020 | Loh et al. | |
| 10,920,521 | B2 * | 2/2021 | Turner | E21B 33/0385 |
| 10,968,734 | B2 * | 4/2021 | Jacob | E21B 47/07 |
| 2014/0360613 | A1 | 12/2014 | Abshire et al. | |
| 2016/0320769 | A1 | 11/2016 | Deffenbaugh et al. | |
| 2019/0264543 | A1 | 8/2019 | Sherman | |
| 2019/0332089 | A1 * | 10/2019 | Deffenbaugh | E21B 47/138 |
| 2020/0072016 | A1 | 3/2020 | Al-Gouhi et al. | |
| 2020/0347704 | A1 | 11/2020 | Wakefield et al. | |
| 2022/0010630 | A1 * | 1/2022 | Musso | E21B 47/13 |
| 2022/0010648 | A1 * | 1/2022 | Musso | E21B 33/12 |

OTHER PUBLICATIONS

Ahmad Al-Khalifah, "Sand Problem in Oil Wells", Slide Show, Dec. 16, 2011, 15 pages.

* cited by examiner

*Primary Examiner* — Jonathan Malikasim
(74) *Attorney, Agent, or Firm* — Bracewell LLP; Constance G. Rhebergen; Linda L. Morgan

(57) ABSTRACT

Embodiments of the disclosure provide a method for retrieving an untethered measurement device used in a subterranean well ascending from a wellbore into a Christmas tree valve. A swab valve of the Christmas tree valve is opened. An expandable meshed component is deployed into the Christmas tree valve through a swab conduit. The expandable meshed component transitions from a compressed configuration to an expanded configuration at a target height in the Christmas tree valve. A production wing valve of the Christmas tree valve is opened. The swab valve is closed. The untethered measurement device is retrieved from the Christmas tree valve through the swab conduit.

18 Claims, 6 Drawing Sheets

POLYMERIC SLEEVE FOR GUIDING AN UNTETHERED MEASUREMENT DEVICE IN A CHRISTMAS TREE VALVE

BACKGROUND

Field of the Disclosure

Embodiments of the disclosure generally relate to a method and apparatus for obtaining measurements of downhole properties in a subterranean well. More specifically, embodiments of the disclosure relate to a method and apparatus for guiding an untethered measurement device for measuring physical, chemical, geological, and structural properties in a subterranean well.

Description of the Related Art

Measurement of downhole properties along a subterranean well is critical to the drilling, completion, operation, and abandonment of wells. These wells may be used for recovering hydrocarbons from subsurface reservoirs, injecting fluids into subsurface reservoirs, and monitoring the conditions of subsurface reservoirs.

The downhole properties relate to the physical, chemical, geological, and structural properties along the wellbore at various stages in the life of the well. For example, the downhole properties include, but are not limited to, pressure, differential pressure, temperature, "water cut," which is a percentage of water or brine present in downhole fluids, volume fractions of oil, brine, or gas in downhole fluids, levels and locations of, and depths to the dew point for gas condensate, liquid condensate, oil, or brine along the well, flow rate of oil, brine, or gas phases, inflow rate of the oil, brine, or gas into the well from surrounding rock formations, the density or viscosity of drilling mud and the depth of invasion of the drilling mud into surrounding rock formations, the thickness or consistency, or degree of coverage of mudcake that may remain on the borehole wall, the chemical composition of the water or brine mixture, the chemical composition of the hydrocarbons, the physical properties of the downhole fluids, including, for example, density or viscosity, the multiphase flow regime, the optical properties of the hydrocarbons or brine such as turbidity, absorption, refractive index, or fluorescence, fluorescing tracers, the amount of or type of corrosion or scale on the casing or production tubing, the rate of corrosion or scale growth, the presence or absence or concentration of corrosion inhibitor or scale inhibitor chemicals that might be added to the well, the open cross-section within the production tubing or borehole which would conventionally be measured by calipers, the acoustical or elastic properties of the surrounding rock, which may be isotropic or anisotropic, the electrical properties of the surrounding rock, including, for example, the surrounding rock's resistive or dielectric properties, which may be isotropic or anisotropic, the density of the surrounding rock, the presence or absence of fractures in the surrounding rock and the abundance, orientation, and aperture of these fractures, the total porosity or types of porosity in the surrounding rock and the abundance of each pore type, the mineral composition of the surrounding rock, the size of grains or distribution of grain sizes and shapes in the surrounding rock, the size of pores or distribution of pore sizes and shapes in the surrounding rock, the absolute permeability of the surrounding rock, the relative permeability of the surrounding rock, the wetting properties of fluids in the surrounding rock, contact angles of the fluids on a surface, and the surface tension of fluid interfaces along the well or in the surrounding rock. These properties are conventionally measured as a function of (or as they vary with) depth or linear distance along the well, or as they vary with another property such as time since deployment of the measurement tool or with pressure as a surrogate for depth.

Downhole properties along a well are measured conventionally using tethered logging tools, which are suspended on a cable, and lowered into the wellbore using, for example, a winch mounted in a logging truck and a crane. In some cases, the conventional tethered logging tools are pushed into the wellbore using, for example, coiled tubing, or pushed or pulled along the wellbore using a tractor, or other similar driving mechanism. Conventional tethered logging tools and the cable or wiring attached thereto are generally bulky, requiring specialized vehicles or equipment and a specialized crew of technicians to deploy and operate. The need to mobilize specialized vehicles and/or other large equipment and to provide a crew of technicians to remote well sites increases the expense associated with well logging and can introduce undesirable delays in obtaining needed data.

Another conventional method for acquiring downhole data uses fiber optic cables, which function as sensor strings, or wired networks of downhole sensors. These fiber optic cables and wired networks are deployed along a well to provide data collection over a longer period of time than is practical with wireline tools. Recorded data from these sensors is generally limited, however, to temperature, pressure or strain, and acoustic data. The cost of deploying such a network of wired measurement devices can be significant, and well operation must be stopped and taken off-line to deploy the long downhole cables.

Accordingly, there is a need for a small, untethered downhole sensor and method of use for measuring downhole properties along a well, which can be deployed by a single individual, preferably a non-specialist technician in the field, without the need for mobilizing specialized logging crews, vehicles, or equipment. There is also a need for well logging using an untethered downhole sensor, which can be deployed along a wellbore, without the need for taking the well off-line and stopping production within the well, killing the well, or installing a blow-out preventer (BOP) and lubricator system for controlling pressure along the well, while logging. There is also a need for an untethered downhole sensor that can carry a wide variety of sensors to measure the physical, chemical, geological, and structural properties along a well, which can be deployed at a small fraction of the cost associated with a conventional tethered downhole sensor. There is also a need for retrieving the deployed untethered downhole sensor after downhole use avoiding the untethered downhole sensor being misdirected during retrieval through a Christmas tree valve.

SUMMARY

Embodiments of the disclosure generally relate to a method and apparatus for obtaining measurements of downhole properties in a subterranean well. More specifically, embodiments of the disclosure relate to a method and apparatus for guiding an untethered measurement device for measuring physical, chemical, geological, and structural properties in a subterranean well.

Embodiments of the disclosure provide a method for retrieving an untethered measurement device used in a subterranean well ascending from a wellbore into a Christmas tree valve. The method includes the step of opening a swab valve of the Christmas tree valve. The method includes the step of deploying an expandable meshed component into the Christmas tree valve through a swab conduit. The expandable meshed component has a substantially cylindrical geometry. The expandable meshed component is in a compressed configuration. The expandable meshed component in the compressed configuration has a diameter less than an inner diameter of the swab conduit. The method includes the step of allowing the expandable meshed component to transition from the compressed configuration to an expanded configuration at a target height in the Christmas tree valve such that the expandable meshed component in the expanded configuration is in contact with interior walls of both the swab conduit and a main conduit. The expandable meshed component is positioned before an entrance of a production wing conduit. The method includes the step of opening a production wing valve of the Christmas tree valve such that production fluids enter the production wing conduit while the untethered measurement device is guided by the expandable meshed component in the expanded configuration, enters the swab conduit, and passes the swab valve. The method includes the step of closing the swab valve. The method includes the step of retrieving the untethered measurement device from the Christmas tree valve through the swab conduit.

In some embodiments, the expandable meshed component includes a swellable material including a polyacrylamide, a polyacrylate, a polysaccharide, starch, clay, an alkaline earth oxide, a superabsorber, and combinations of the same. In some embodiments, in the allowing step, the swellable material contacts a water-based fluidic component such that the expandable meshed component transitions from the compressed configuration to the expanded configuration. In some embodiments, the expandable meshed component includes a swellable material including ethylene-propylene-copolymer rubber, ethylene-propylene-diene terpolymer rubber, butyl rubber, halogenated butyl rubber, styrene butadiene rubber, ethylene propylene diene monomer rubber, natural rubber, ethylene vinyl acetate rubber, hydrogenized acrylonitrile-butadiene rubber, acrylonitrile butadiene rubber, isoprene rubber, chloroprene rubber, polynorbornene, and combinations of the same. In some embodiments, in the allowing step, the swellable material contacts an oil-based fluidic component such that the expandable meshed component transitions from the compressed configuration to the expanded configuration. In some embodiments, the expandable meshed component comprises a meshed sheet having a meshed structure capable of shrinking in a lateral direction allowing the substantially cylindrical geometry of the expandable meshed component to shrink in a radial direction.

Embodiments of the disclosure also provide a method for measuring properties along a subterranean well. The method includes the step of opening a swab valve of a Christmas tree valve. The method includes the step of descending an untethered measurement device into the subterranean well via the Christmas tree valve. The method includes the step of deploying an expandable meshed component into the Christmas tree valve through a swab conduit. The expandable meshed component has a substantially cylindrical geometry. The expandable meshed component is in a compressed configuration. The expandable meshed component in the compressed configuration has a diameter less than an inner diameter of the swab conduit. The method includes the step of allowing the expandable meshed component to transition from the compressed configuration to an expanded configuration at a target height in the Christmas tree valve such that the expandable meshed component in the expanded configuration is in contact with interior walls of both the swab conduit and a main conduit. The expandable meshed component is positioned before an entrance of a production wing conduit. The method includes the step of taking measurements using the untethered measurement device including physical properties in the subterranean well, chemical properties in the subterranean well, structural properties in the subterranean well, dynamics of the untethered measurement device, position of the untethered measurement device, and combinations of the same. The method includes the step of opening a production wing valve of the Christmas tree valve such that production fluids enter the production wing conduit while the untethered measurement device is guided by the expandable meshed component in the expanded configuration, enters the swab conduit, and passes the swab valve. The method includes the step of closing the swab valve. The method includes the step of retrieving the untethered measurement device from the Christmas tree valve through the swab conduit.

In some embodiments, the untethered measurement device includes a sensor configured to measure the data along the subterranean well as the untethered measurement device descends and ascends within the subterranean well. In some embodiments, the sensor includes a position sensor configured to calculate an amount of time that the untethered measurement device has been descending down into the subterranean well to determine a location at which the untethered measurement device is positioned along the subterranean well. In some embodiments, the sensor includes a position sensor including a casing or tubing collar detector configured to detect when the untethered measurement device passes a casing or tubing collar along the subterranean well and counts a number of the casing or tubing collars, which have been passed in the subterranean well, to determine a location at which the untethered measurement device is positioned along the subterranean well. In some embodiments, the sensor includes a downhole property sensor configured to measure one or more downhole properties of the one or more downhole fluids in the subterranean well. In some embodiments, the sensor includes a position sensor including a detector configured to sense a gap between casing or tubing joints when the untethered measurement device passes the gap along the subterranean well and further configured to count a number of the gaps which have been passed in the subterranean well, to determine a location at which the untethered measurement device is positioned along the subterranean well. In some embodiments, the untethered measurement device includes a processor configured to control the sensor measuring the data and to store the data, wherein the processor comprises instructions definining measurement parameters for the sensor of the untethered measurement device within the subterranean well. In some embodiments, the untethered measurement device includes a non-transitory computer-readable medium in communication with the processor having computer-readable instructions stored therein. In some embodiments, the untethered measurement device includes a transmitter configured to transmit the data to a receiver arranged external to the subterranean well. In some embodiments, the expandable meshed component includes a swellable material including a polyacrylamide, a polyacrylate, a polysaccharide, starch, clay, an alkaline earth oxide, a superabsorber, and combinations of the same. In some embodiments, the expandable meshed component includes a swellable material including ethylene-propylene-copolymer rubber, ethylene-propylene-diene terpolymer rubber, butyl rubber, halogenated butyl rubber, styrene butadiene rubber, ethylene propylene diene monomer rubber, natural rubber, ethylene vinyl acetate rubber, hydrogenized acrylonitrile-butadiene rubber, acrylonitrile butadiene rubber, isoprene rubber, chloroprene rubber, polynorbornene, and combinations of the same. In some embodiments, the expandable meshed component includes a meshed sheet having a meshed structure capable of shrinking in a lateral direction allowing the substantially cylindrical geometry of the expandable meshed component to shrink in a radial direction.

BRIEF DESCRIPTION OF THE DRAWINGS

So that the manner in which the previously-recited features, aspects, and advantages of the embodiments of this disclosure as well as others that will become apparent are attained and can be understood in detail, a more particular description of the disclosure briefly summarized previously may be had by reference to the embodiments that are illustrated in the drawings that form a part of this specification. However, it is to be noted that the appended drawings illustrate only certain embodiments of the disclosure and are not to be considered limiting of the disclosure's scope as the disclosure may admit to other equally effective embodiments.

Figure 1:
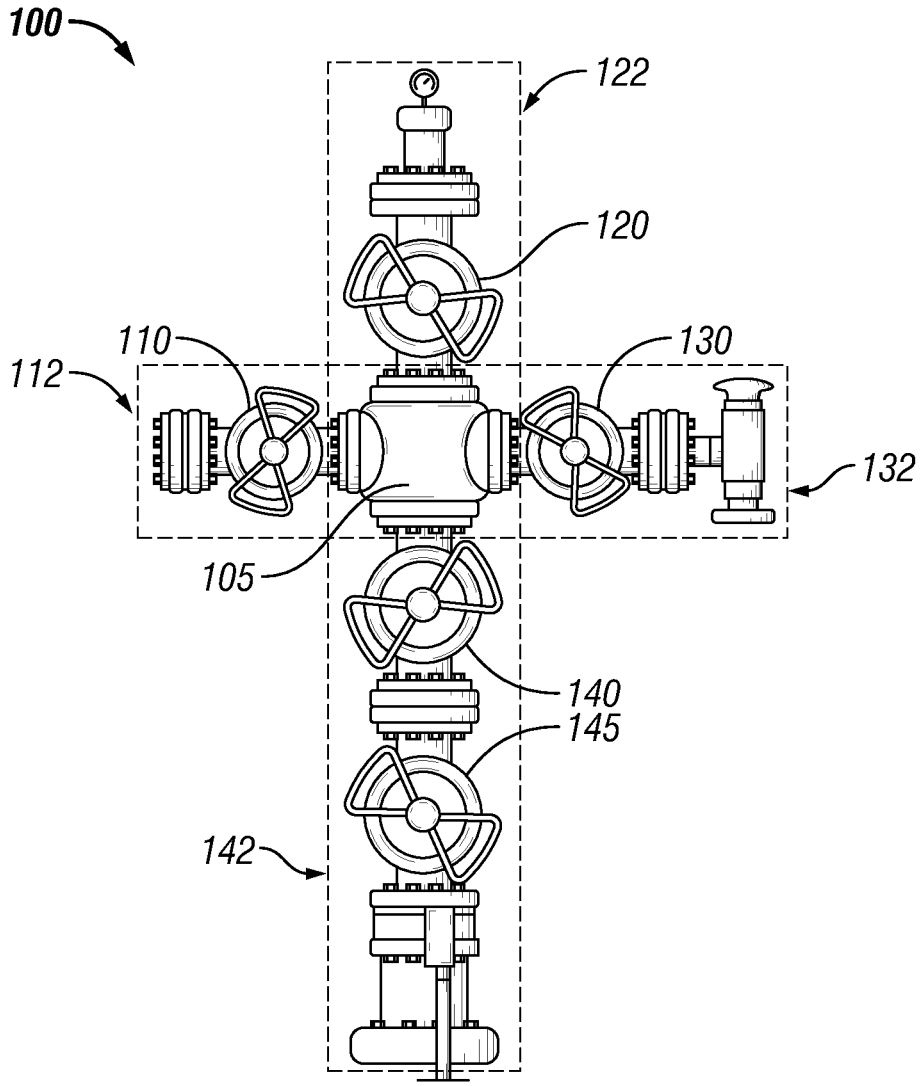
FIG. 1 is a schematic view of a conventional Christmas tree valve.

In the accompanying Figures, similar components or features, or both, may have a similar reference label.

DETAILED DESCRIPTION

The disclosure refers to particular features, including process or method steps. Those of skill in the art understand that the disclosure is not limited to or by the description of embodiments given in the specification. The subject matter of this disclosure is not restricted except only in the spirit of the specification and appended claims.

Those of skill in the art also understand that the terminology used for describing particular embodiments does not limit the scope or breadth of the embodiments of the disclosure. In interpreting the specification and appended claims, all terms should be interpreted in the broadest possible manner consistent with the context of each term. All technical and scientific terms used in the specification and appended claims have the same meaning as commonly understood by one of ordinary skill in the art to which this disclosure belongs unless defined otherwise.

Although the disclosure has been described with respect to certain features, it should be understood that the features and embodiments of the features can be combined with other features and embodiments of those features.

Although the disclosure has been described in detail, it should be understood that various changes, substitutions, and alternations can be made without departing from the principle and scope of the disclosure. Accordingly, the scope of the present disclosure should be determined by the following claims and their appropriate legal equivalents.

As used throughout the disclosure, the singular forms "a," "an," and "the" include plural references unless the context clearly indicates otherwise.

As used throughout the disclosure, the word "about" includes +/−5% of the cited magnitude.

As used throughout the disclosure, the words "comprise," "has," "includes," and all other grammatical variations are each intended to have an open, non-limiting meaning that does not exclude additional elements, components or steps. Embodiments of the present disclosure may suitably "comprise," "consist," or "consist essentially of" the limiting features disclosed, and may be practiced in the absence of a limiting feature not disclosed. For example, it can be recognized by those skilled in the art that certain steps can be combined into a single step.

As used throughout the disclosure, the words "optional" or "optionally" means that the subsequently described event or circumstances can or may not occur. The description includes instances where the event or circumstance occurs and instances where it does not occur.

Where a range of values is provided in the specification or in the appended claims, it is understood that the interval encompasses each intervening value between the upper limit and the lower limit as well as the upper limit and the lower limit. The disclosure encompasses and bounds smaller ranges of the interval subject to any specific exclusion provided.

Where reference is made in the specification and appended claims to a method comprising two or more defined steps, the defined steps can be carried out in any order or simultaneously except where the context excludes that possibility.

As used throughout the disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope of the present disclosure.

As used throughout the disclosure, spatial terms described the relative position of an object or a group of objects relative to another object or group of objects. The spatial relationships apply along vertical and horizontal axes. Orientation and relational words, including "uphole," "downhole," "upper," "lower," and other like terms, are for descriptive convenience and are not limiting unless otherwise indicated.

As used throughout the disclosure, the term "Christmas tree" or "Christmas tree valve" refers to an assembly of valves, spools, pressure gauges, and chokes connected to the top of a well to direct and control the flow of formation fluids from the well. A Christmas tree valve can be used in applications such as water injection, water disposal, and gas injection. In addition, a Christmas tree valve can used as chemical injection points, well intervention means, pressure relief means (such as an annulus vent), and well monitoring points (such as pressure, temperature, corrosion, erosion, sand detection, flow rate, flow composition, valve and choke position feedback, connection points for devices such as downhole pressure and temperature transducer).

Embodiments of the disclosure generally relate to a method and apparatus for obtaining measurements of downhole properties in a subterranean well. More specifically, embodiments of the disclosure relate to a method and apparatus for guiding an untethered measurement device for measuring physical, chemical, geological, and structural properties in a subterranean well.

FIG. 1 is a schematic view of a conventional Christmas tree valve 100. The Christmas tree valve 100 includes five valves: a kill wing valve 110, a swab valve 120, a production wing valve 130, an upper master valve 140, and a lower master valve 145. The kill wing valve 110 is positioned in the kill wing conduit 112. The swab valve 120 is positioned in the swab conduit 122. The production wing valve 130 is positioned in the production wing conduit 132. The upper master valve 140 and the lower master valve 145 are positioned in the main conduit 142 where production fluids must pass to arrive at the surface. In some embodiments, there is one master valve in lieu of the upper master valve 140 and the lower master valve 145. The kill wing valve 110 is used for injection of fluids such as corrosion inhibitors or methanol to prevent hydrate formation. The swab valve 120 is used for well interventions such as wireline and coiled tubing. The swab valve 120 is also used for deploying and retrieving an untethered measurement device. The production wing valve 130 is positioned in the flow path where production fluids are sent to production facilities. The cross joint zone 105 is positioned at the intersection of the kill wing conduit 112, the swab conduit 122, the production wing conduit 132, and the main conduit 142.

An untethered measurement device can be deployed from the swab valve 120 and pass through the upper master valve 140 and the lower master valve 145 into the wellbore (not shown). While in the wellbore, the untethered measurement device can measure physical, chemical, geological, or structural properties of the well or the dynamics of the untethered measurement device. After taking certain measurements, the untethered measurement device can be retrieved at the surface via the Christmas tree valve 100 where the untethered measurement device ascends from the wellbore through the main conduit 142 passing the lower master valve 145 and the upper master valve 140. In some embodiments, the untethered measurement device can change its buoyancy or drag to descend, ascend, or maintain a stationary position in the wellbore. In some embodiments, the untethered measurement device ascends from the wellbore along with oil-based fluids (such as production fluids) or water-based fluids.

Potential difficulties may arise when the untethered measurement device ascends from the wellbore along with the production fluids through the production wing conduit 132. Because the production wing valve 130 is open during production, the untethered measurement device, instead of entering the swab conduit 122 after ascending through the main conduit 142 passing the lower master valve 145 and the upper master valve 140, can be misdirected by entering the production wing conduit 132 along with the production fluids.

Figure 2:
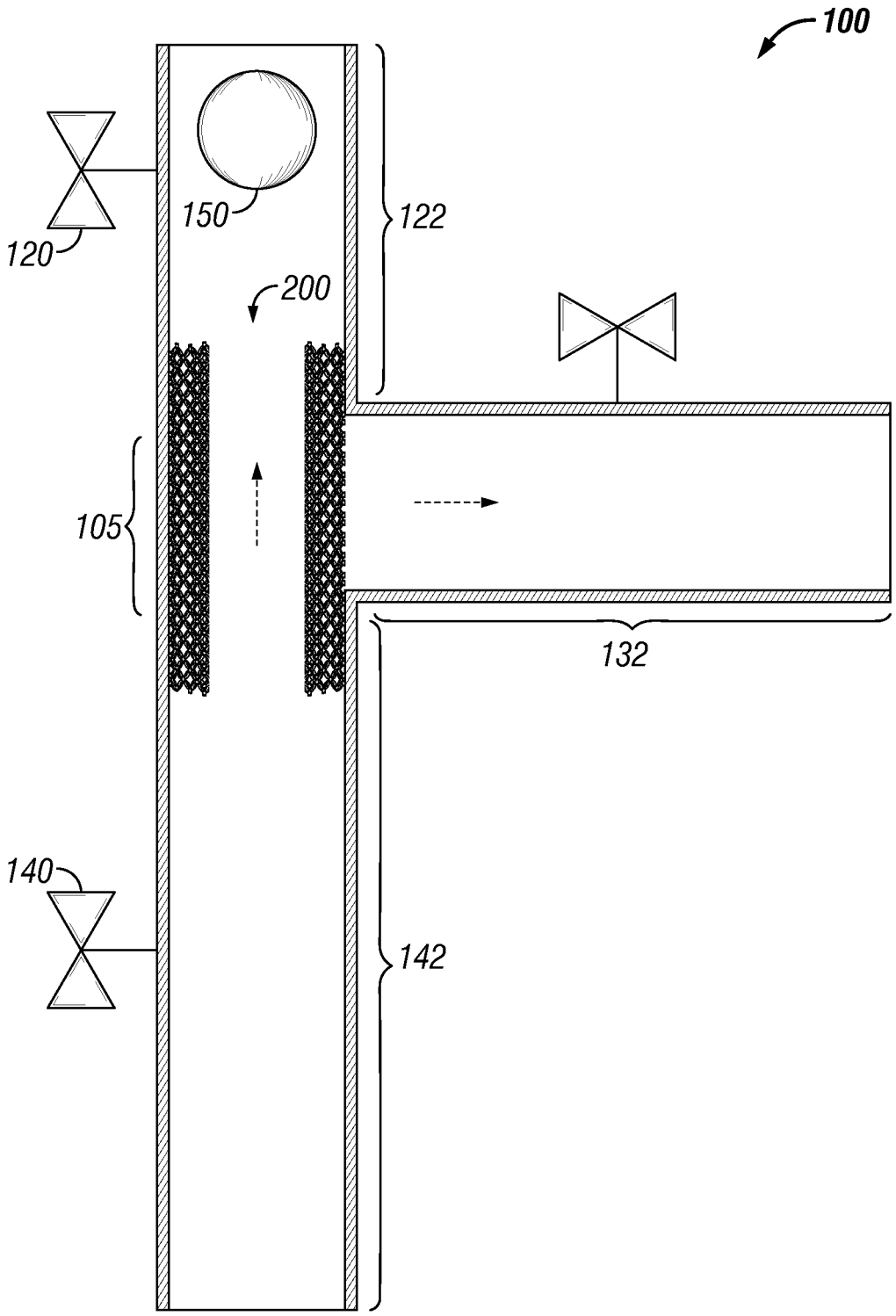
FIG. 2 is a cross-sectional schematic view of an expandable meshed component in an expanded configuration for guiding the ascent of an untethered measurement device in a Christmas tree valve, according to an embodiment of the disclosure.

To mitigate the untethered measurement device from being misdirected into the production wing conduit 132 during retrieval, FIG. 2 shows a cross-sectional schematic view of an expandable meshed component 200 in an expanded configuration for guiding the ascent of the untethered measurement device 150 in a Christmas tree valve 100, according to an embodiment of the disclosure. FIG. 2 shows a simplified version of a Christmas tree valve 100 including a swab valve 120, a swab conduit 122, a production wing valve 130, a production wing conduit 132, a master valve 140, and a main conduit 142. The inner diameter of the swab conduit 122 is greater than the diameter of the untethered measurement device. The inner diameter of the production wing conduit 132 is greater than the diameter of the untethered measurement device. The inner diameter of the main conduit 142 is greater than the diameter of the untethered measurement device. The expandable meshed component 200 is positioned radially in the uphole portion of the main conduit 142 above the master valve 140, the downhole portion the swab conduit 122 below the swab valve 120, and the cross joint zone 105. In this manner, the expandable meshed component 200 is positioned before the entrance of the production wing conduit 132. Due to the meshed structure of the expandable meshed component 200, the swab conduit 122, the production wing conduit 132, the main conduit 142, and the cross joint zone 105 are in fluid contact with one another. Due to the expandable meshed component 200 being expandable and exhibiting elastic force in the radial direction, the expandable meshed component is in contact with the interior surfaces of the main conduit 142, the swab conduit 122, and the cross joint zone 105, which have substantially cylindrical geometries. As the untethered measurement device 150 ascends from main conduit 142, the expandable meshed component 200 maintains the ascent of the untethered measurement device 150 to the swab conduit 122 such that the untethered measurement device 150 can be retrieved via the swab conduit 122. The expandable meshed component 200 is prevented from entering the production wing conduit 132. The production fluids continue to pass through the production wing conduit 132. One skilled in the relevant art would recognize that the expandable meshed component 200, in the expanded configuration, need not be a rigid one to guide the ascent of the untethered measurement device 150.

Figure 3A:
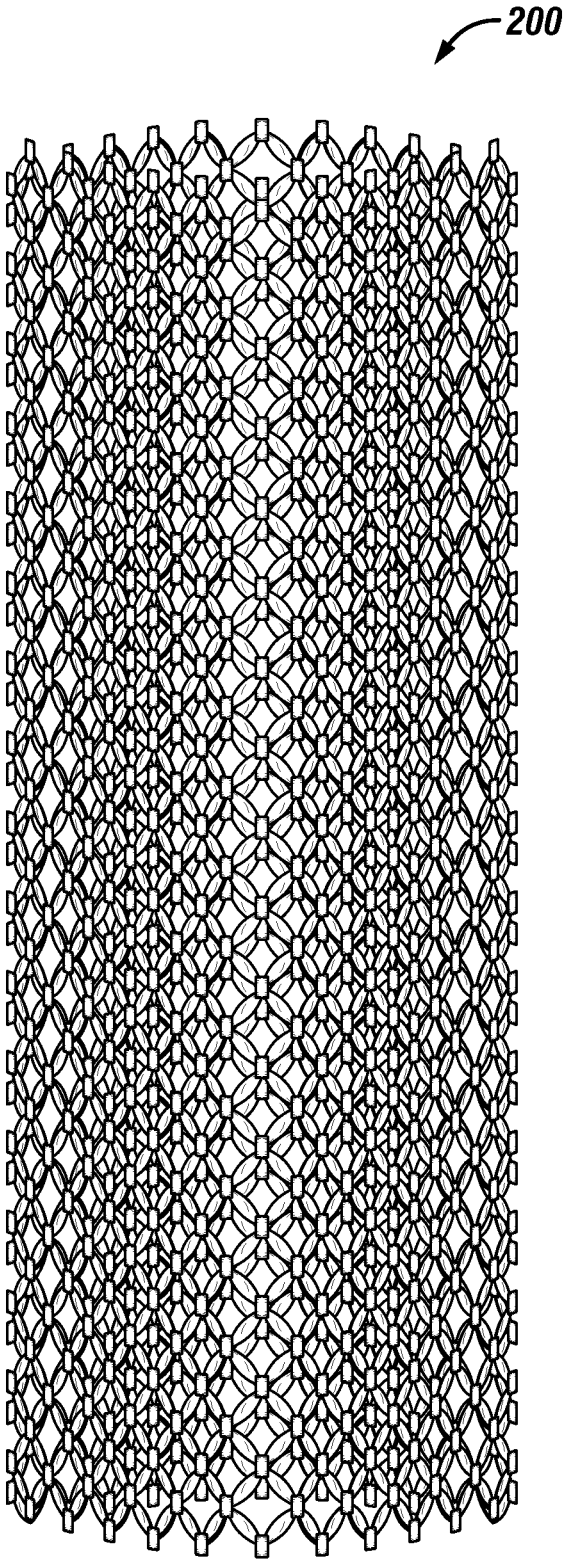
FIG. 3A is a longitudinal cross-sectional view of the expandable meshed component in the expanded configuration, according to an embodiment of the disclosure.
Figure 3B:
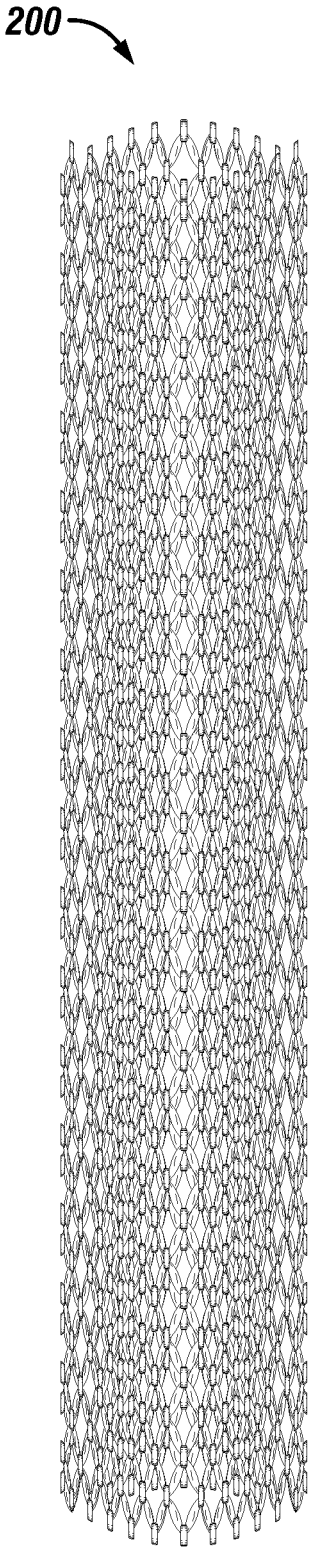
FIG. 3B is a longitudinal cross-sectional view of the expandable meshed component in a compressed configuration, according to an embodiment of the disclosure.

FIG. 3A is a longitudinal cross-sectional view of the expandable meshed component 200 in the expanded configuration, according to an embodiment of the disclosure. FIG. 3B is a longitudinal cross-sectional view of the expandable meshed component 200 in a compressed configuration, according to an embodiment of the disclosure.

As shown in FIG. 3A, the expandable meshed component 200 in the expanded configuration has a substantially cylindrical geometry. The diameter of the expandable meshed component 200 in the expanded configuration is equal to or greater than the inner diameter of the swab conduit 122 or the main conduit 142, or both. In this manner, the expandable meshed component 200 can be in contact with the inner walls of the swab conduit 122 or the main conduit 142, or both, and maintain its position for guiding the untethered measurement device 150, as shown in FIG. 2. The longitudinal length of the expandable meshed component 200 is greater than the inner diameter of the production wing conduit 132. In this manner, the expandable meshed component 200 is prevented from entering the production wing conduit 132. One skilled in the relevant art would recognize that the dimensions of the expandable meshed component 200 may vary depending on the dimensions of the swab conduit 122, the main conduit 142, and the production wing conduit 132.

As shown in FIG. 3B, the expandable meshed component 200 in the compressed configuration has a substantially cylindrical geometry. The diameter of the expandable meshed component 200 in the compressed configuration is less than the inner diameter of the swab conduit 122 and the main conduit 142. In this manner, the expandable meshed component 200 in the compressed configuration can be deployed into the Christmas tree valve 100 via the swab conduit 122. The longitudinal length of the expandable meshed component 200 is greater than the inner diameter of the production wing conduit 132. In this manner, the expandable meshed component 200 is prevented from entering the production wing conduit 132. One skilled in the relevant art would recognize that the dimensions of the expandable meshed component 200 may vary depending on the dimensions of the swab conduit 122, the main conduit 142, and the production wing conduit 132.

In some embodiments, a sleeve (not shown) can surround the radially exterior surface of the expandable meshed component 200 such that the expandable meshed component 200 maintains its compressed configuration. In some embodiments, the sleeve includes an inelastic material such as a metal or inelastic polymer to assure that the expandable meshed component 200 does not expand while being deployed into the Christmas tree valve 100. The diameter of the sleeve is less than the inner diameter of the swab conduit 122 and the main conduit 142. In some embodiments, the sleeve can include a degradable material such that the expandable meshed component 200 transitions from the compressed configuration to the expanded configuration upon degradation of the sleeve. In some embodiments, the sleeve can include a latch system such that the expandable meshed component 200 transitions from the compressed configuration to the expanded configuration upon opening of the sleeve.

Figure 4A:
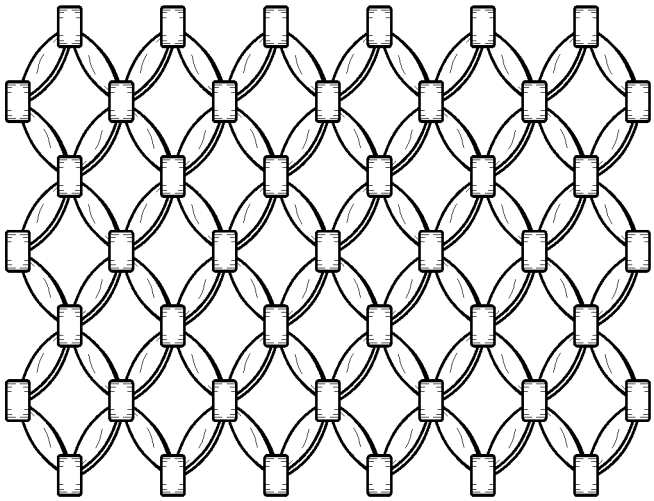
FIG. 4A is perspective view of a meshed sheet of the expandable meshed component in the expanded configuration, according to an embodiment of the disclosure.
Figure 4B:
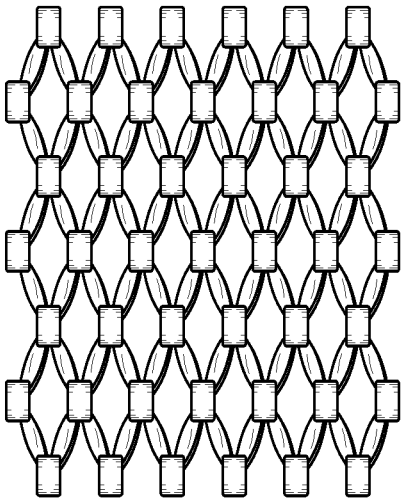
FIG. 4B is perspective view of the meshed sheet of the expandable meshed component in the compressed configuration, according to an embodiment of the disclosure.

FIG. 4A is perspective view of a meshed sheet of the expandable meshed component 200 in the expanded configuration, according to an embodiment of the disclosure. FIG. 4B is perspective view of the meshed sheet of the expandable meshed component 200 in the compressed configuration, according to an embodiment of the disclosure. The expandable meshed component 200 includes at least one layer of a meshed sheet. The meshed sheet has a meshed structure, which can shrink and expand in the lateral direction (that is, the horizontal direction of FIGS. 4A and 4B). The meshed structure has a unit cell resembling a rhombus. One skilled in the relevant art would recognize that the dimensions of the unit cell (including the shorter diagonal, the longer diagonal, and the thickness) may vary depending on the dimensions of the expandable meshed component 200. The cross-section of the meshed structure can be circular or quadrangular (including a square cross-section). The shrinking in the lateral direction allows the substantially cylindrically shaped expandable meshed component 200 to shrink in the radial direction such that the expandable meshed component 200 can transition from the original expanded configuration to the compressed configuration. The expansion in the lateral direction allows the substantially cylindrically shaped expandable meshed component 200 to expand in the radial direction such that the expandable meshed component 200 can transition from the compressed configuration to the original expanded configuration.

In some embodiments, the expandable meshed component 200 includes a swellable material. The swellable material is capable of swelling such that the expandable meshed component 200 transitions from the compressed configuration to the expanded configuration.

The swellable material can be capable of swelling upon contact with a water-based fluidic component permeating into the expandable meshed component 200. Non-limiting examples of the swellable material can include polymers such as polyacrylamide, and polyacrylate. Non-limiting examples of the swellable material can include polysaccharides such as xanthan gum. Non-limiting examples of the swellable material can include starch and clay (such as bentonite). Non-limiting examples of the swellable material can include alkaline earth oxides such as magnesium oxide and calcium oxide. Non-limiting examples of the swellable material can include superabsorbers. As used throughout the disclosure, the term "superabsorber" refers to a swellable, crosslinked polymer that, by forming a gel, is capable of absorbing and storing many times its own weight of water-based liquids. Superabsorbers retain the water-based liquid that they absorb and typically do not release the absorbed liquids, even under pressurized conditions. Superabsorbers also increase in volume upon absorption of the water-based liquid they absorb. Non-limiting examples of superabsorbers can include acrylamide-based polymers, acrylate-based polymers, and hydrogel, all of which are capable of forming crosslinked three-dimensional molecular networks. Other non-limiting examples of the swellable material include starch-polyacrylate acid graft copolymer, polyvinyl alcohol cyclic acid, anhydride graft copolymer, isobutylene maleic anhydride, acrylic acid type polymers, vinylacetate-acrylate copolymer, polyethylene oxide polymers, carboxymethylcellulose type polymers, and starch-polyacrylonitrile graft copolymers.

In alternate embodiments, the swellable material can be capable of swelling upon contact with an oil-based fluidic component permeating into the swellable packer 200. Non-limiting examples of the swellable material include ethylene-propylene-copolymer rubber, ethylene-propylene-diene terpolymer rubber, butyl rubber, halogenated butyl rubber such as brominated butyl rubber and chlorinated butyl rubber, styrene butadiene rubber, ethylene propylene diene monomer rubber, natural rubber, ethylene vinyl acetate rubber, hydrogenized acrylonitrile-butadiene rubber, acrylonitrile butadiene rubber, isoprene rubber, chloroprene rubber, and polynorbornene.

In some embodiments, the swellable material is suitable for additive manufacturing. Non-limiting examples of the additive manufacturing material include silicone elastomer, nitrile elastomer (NBR), hydrogenated nitrile elastomer (HNBR), ethylene propylene diene monomer elastomer (EPDM), fluoro-elastomer (FKM), perfluoro-elastomer (FFKM), tetrafluoro ethylene propylene elastomer (FEPM), polylactic acid (PLA), acrylonitrile butadiene styrene (ABS), wood fiber (a combination of cellulose and PLA), polyethylene terephthalate (PET), polyvinyl alcohol (PVA), nylon, and thermoplastic urethane (TPU). The additive manufacturing material is capable of retaining its mechanical performance in downhole conditions and does not degrade in an aqueous or oil-based environment.

In an embodiment of the method, the expandable meshed component 200 is manufactured via additive manufacturing using the additive manufacturing material.

In some embodiments, the expandable meshed component 200 can be externally coated with a material suitable for reducing friction. Non-limiting examples of the friction-reducing material can include polytetrafluoroethylene (PTFE).

In some embodiments, the expandable meshed component 200 can include a material suitable for reducing density. Non-limiting examples of the density-reducing material can include glass microspheres, such as K46 (3M Co., Maplewood, Minn.), iM30K (3M Co., Maplewood, Minn.), S60HS (3M Co., Maplewood, Minn.), S60 (3M Co., Maplewood, Minn.), and S38HS (3M Co., Maplewood, Minn.).

In some embodiments, the expandable meshed component 200 can include a degradable polymer. The degradable polymer can be oil-soluble or water-soluble, or both. Non-limiting examples of the degradable polymer include PLA, polyglycolic acid (PGA), PVA, and polyethylene glycol (PEG). Non-limiting examples of the degradable polymer include polyesters (for example, polylactate), polyamides, polyureas, polyurethanes, polyethylene oxide, polyvinyl acetate, polyethylene, polypropylene, polyvinylchloride (PVC), polyvinylidenechloride, ethylene-vinylacetate (EVA) copolymer, poly(ether or ketone), and polyanhydrides. Non-limiting examples of the degradable polymer include water soluble polymers. Non-limiting examples of the degradable polymer include hydroxyethyl cellulose, carboxymethyl cellulose, sodium carboxymethyl hydroxyethyl cellulose, methylhydroxypropyl cellulose, starches, cellulose triesters, and styrene-butadiene based latex. Non-limiting examples of the degradable polymer include polymer blends having natural polymers such as starch-based blends, and polymer blends having water soluble polymers such as PLA-based blends. In some embodiments, certain polymers are dissolvable or degradable via hydrolysis. In some embodiments, certain polymers are capable of dissolving or degrading via thermo-oxidation. The degradable polymer can degrade and dissolve in the oil-based or water-based fluids occupying the interior of the Christmas tree valve 100 once the task of retrieving the untethered measurement device 150 is completed.

The swellable material, in the expanded configuration, can have a volume up to about 30 times the compressed volume, alternately up to about 10 times the compressed volume, or alternately up to about 5 times the compressed volume. The swellable material can exist in granular form or powder form. In granular form or powder form, the swellable material, in the non-swollen configuration, can have a dimension less than about 30 millimeters (mm) in diameter, alternately less than about 15 mm in diameter, or less than about 5 mm in diameter. In granular form or powder form, the swellable material is encompassed by a membrane that is permeable. The membrane is not degradable by the fluidic component, either water-based or oil-based, permeating through the membrane into the swellable material. The membrane can be flexible or elastic such that the membrane does not burst upon swelling of the swellable material.

In some embodiments, the expandable meshed component 200 can be substituted with a meshed component that is capable of mechanically expanding by electro-mechanical forces. In some embodiments, the expandable meshed component 200 can be substituted with an inflatable meshed component that is capable of mechanically expanding by gas inflation.

Figure 5:
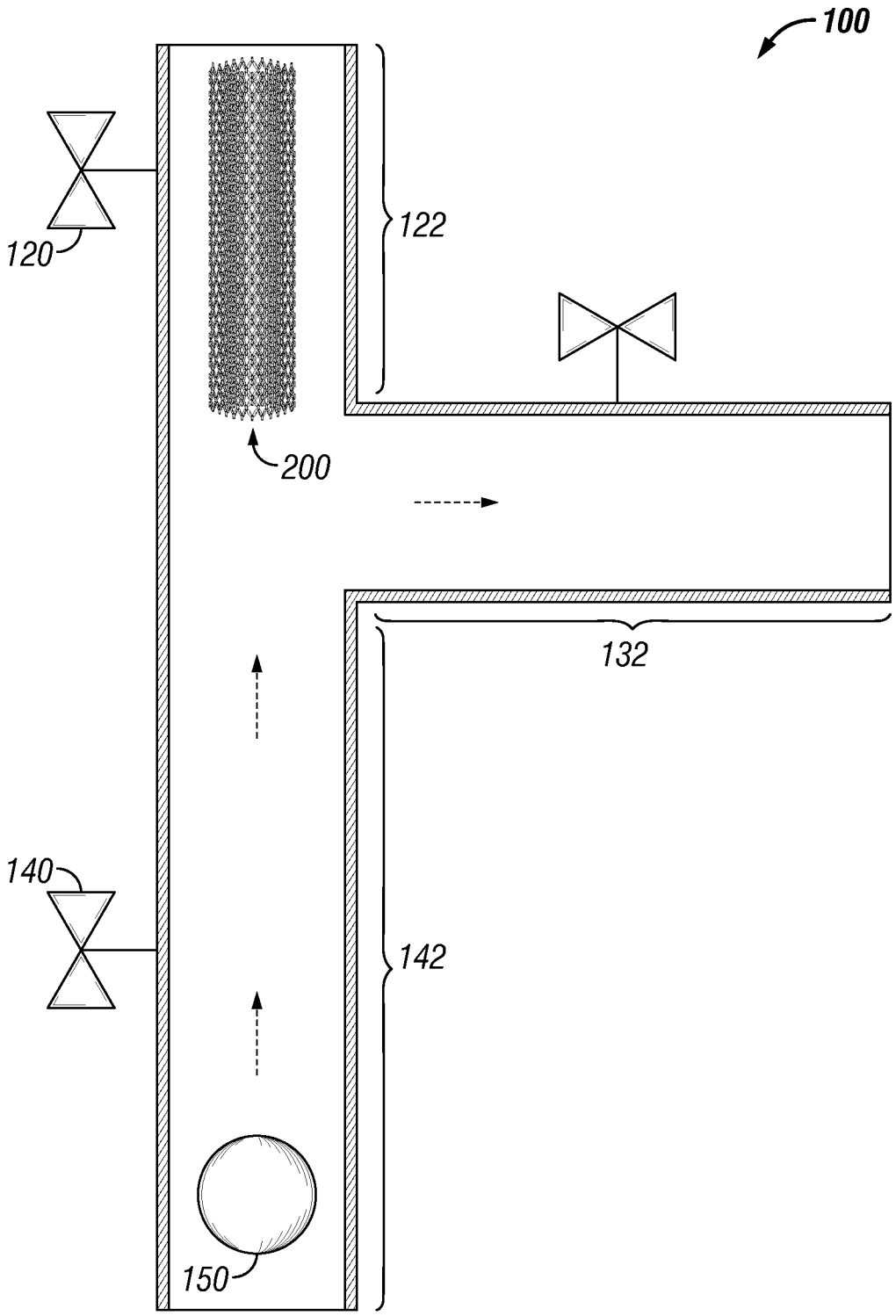
FIG. 5 is a cross-sectional schematic view of deploying the expandable meshed component in the Christmas tree valve, according to an embodiment of the disclosure

FIG. 5 shows a cross-sectional schematic view of deploying the expandable meshed component 200 in the Christmas tree valve 100, according to an embodiment of the disclosure. During deployment, the expandable meshed component 200 is in the compressed configuration. In some embodiments, a sleeve (not shown) may surround the radially exterior surface of the expandable meshed component 200 such that the expandable meshed component 200 maintains its compressed configuration. Once the expandable meshed component 200 is positioned at the target height, the expandable meshed component 200 is allowed to transition from the compressed configuration to the expanded configuration as shown in FIG. 2, making contact with the interior walls of both the swab conduit 122 and the main conduit 142.

After the untethered measurement device 150 takes certain measurements in the wellbore, in some embodiments, the untethered measurement device 150 changes its buoyancy or drag to ascend. In alternate embodiments, the untethered measurement device 150 ascends along with the production fluid. Due to the expandable meshed component 200 being placed in a setting as shown in FIG. 2, the ascending untethered measurement device 150 is forced to enter the swab conduit 122 while being prevented to enter the production wing conduit 132. Due to the meshed structure of the expandable meshed component 200, the production fluids are allowed to enter the production wing conduit 132 for production. The untethered measurement device 150 is retrieved via the top of the swab conduit 122.

In some embodiments, the untethered measurement device 150 detects gaps between ends of casing joints or tubing joints by means of an inductive detector. The inductive detector includes two identical short solenoid coils of wire having the same radius, length, and number of turns and positioned on the untethered device such that they have a common axis. The coils would typically have the same radius as the untethered device and be positioned at its two ends (in the case of a cylindrical untethered device). Electrically, the coils are connected in a bridge configuration, for example, where they are in series and form one side of the bridge and the other side of the bridge is formed by two equal resistors in series. The bridge is driven by a frequency of typically 100 Hz to 1 MHz (preferably 3 kHz) and a differential amplifier measures the degree of imbalance across the bridge. The driving frequency of the bridge is selected to be as high as possible, except that the skin depth for electromagnetic waves in the fluids within the well must be much larger (for example one thousand times larger) than the radius of the well so that the inductive coupling from each coil to the pipe is the same regardless of the position of the untethered device within the pipe.

In some embodiments, if the coils are in a long uniform metal pipe, such as a tubing or casing section of equal diameter, their inductive coupling to the pipe will be equal and their inductance will be equal to each other, regardless of the position of the coils within the pipe or the inclination of their common axis relative to the pipe. In this case, no signal or a very small signal will be detected by the differential amplifier. If one coil is in a slightly larger diameter pipe than the other, as when one of them is close to the gap between pipe sections, then its inductance will be slightly larger than the other and the bridge will be out of balance, and a large amplitude signal will be detected by the differential amplifier. A microcontroller measures the amplitude of the signal from the differential amplifier (for example, using an analog to digital converter), and when the amplitude of this signal is larger, it knows that one coil or the other is near a gap between pipe sections. The microcontroller keeps track of how many such gaps it has passed and using records of the length of each pipe joint (which is recorded when constructing the well or may be mapped by running a casing collar locator logging tool in the well), it determines its own depth. When passing between gaps, the untethered device interpolates its position between pipe ends by dead reckoning based on accelerometer or inertial navigation unit measurements.

In some embodiments, the untethered measurement device 150 is used to obtain measurements along producing wells, which are producing fluids from downhole for at least part of the time while the apparatus is in the well or along pressurized wells, which contain a pressure at the well head, which is (or might be) in excess of ambient pressure outside the well head. In this embodiment, the untethered device is inserted and recovered through a "Christmas tree" valve assembly found at the top of the well. the At the top of the Christmas tree is generally a "swab valve", which is closed during production, but is opened to access the production tubing for cleaning or running wireline tools. Below the swab valve is a T-junction where a "production wing" extends horizontally off the Christmas tree to carry produced fluids to the production facilities. A "production wing valve" is normally open during production, but blocks flow through the production wing when closed. Below the production wing, a "master valve" is normally open during production, but can be closed to block fluids from coming up the well. In some embodiments, to deploy and recover the untethered measurement device 150 in a well with such a Christmas tree, two components can be added. First, a screen or short pipe section with slits that pass the produced fluids, but do not pass the untethered measurement device 150, is inserted through the swab valve into the Christmas tree, so that it allows flow out the production wing but will not allow the untethered measurement device 150 to pass out the production wing. Second, a sensor such as an acoustic detector is attached to the Christmas tree near the production wing which detects the presence of the untethered measurement device 150 in the production wing, for example by detecting an acoustic transmission from the untethered device. To begin deployment of the untethered measurement device 150, the master valve and production wing valves are closed. The untethered measurement device 150 is inserted through the swab valve which is closed behind it. Then the master valve is opened allowing the untethered device to fall into the well. If the measurements are to be made during production, the production wing valve is opened to allow production to resume. When the sensor returns to the surface, it will be trapped between the master valve and the swab valve and prevented from exiting the production arm by the screen. Once the sensor detects its presence near the production arm, the master valve and production arm valves are closed and the swab valve is opened at which point the untethered device is lifted from the Christmas tree through the swab valve.

One skilled in the art would recognize that the process of releasing and recovering the untethered measurement device 150 is not possible with other conventional downhole measurement tools. For example, wireline or slickline tools have cables attached which exit the top of the Christmas tree during the time the tool is in the well. Such cable prevents closing the swab valve as well as closing the master control valve while the tool is in the well. To operate such tools in a pressurized well, a lubricator system must be attached to the top of the well which allows the cable to pass into the well while simultaneously containing the pressure in the well. The lubricator system must be as long as the tool so it can contain the tool when the Christmas tree valves are closed. This requires crew and heavy equipment to attach and remove the lubricator system and the crew must be continually at the well while making measurements to make sure the lubricator is operating properly. Also, other untethered downhole tools are generally too long to fit in the space between the swab valve and the master control valve, preventing both valves from being simultaneously closed while the tool is between them, and preventing the Christmas tree from being used as a pressure lock system when releasing and recovering the tool from the well. Unexpectedly and surprisingly, embodiments of the disclosure enables the untethered measurement device 150 to be released and recovered from a well using the existing valves on the Christmas tree to contain the pressure in the well without requiring a lubricator or any other additional attachment to the Christmas tree. This convenience of using the existing valves allows an operator to deploy or recover the untethered measurement device 150 in less than about 5 minutes with no additional equipment or crew.

Figure 6:
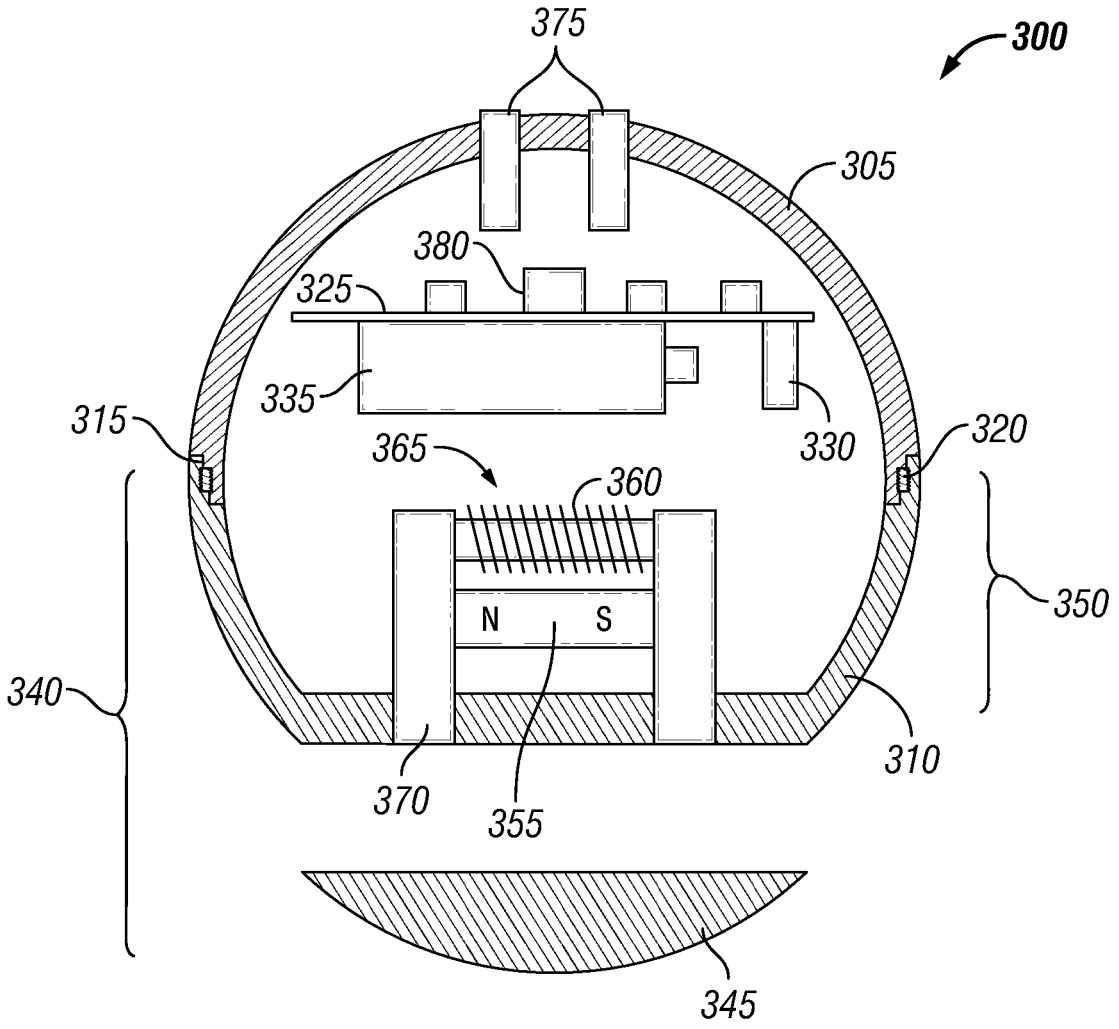
FIG. 6 is a cross-sectional view of the untethered measurement device, according to an embodiment of the disclosure.

FIG. 6 shows a cross-sectional view of an untethered measurement device 300 according to an embodiment of the disclosure. As shown in FIG. 6, the untethered measurement device 300 includes a housing having two hemispheres 305, 310. The two hemispheres 305, 310 have edges that enable the two hemispheres 305, 310 to be secured to one another. According to at least one embodiment, the two hemispheres of the housing 305, 310 have threaded edges 315, such that the two hemispheres of the housing 305, 310 can be screwed to one another. One of ordinary skill in the relevant art would have understood that other securing means could be used for removably securing the two hemispheres of the housing 305, 310 to one another.

As further shown in FIG. 6, the housing, according to at least one embodiment of the invention, further includes a seal 320, for example, an O-ring, arranged between the two hemispheres of the housing 305, 310 to provide a seal therebetween for protecting an internal cavity within the housing from external pressure or damage from an element (for example, one or more downhole fluids) in the well, when the two hemispheres of the housing 305, 310 are secured to one another.

According to at least one embodiment, the two hemispheres of the housing 305, 310 can be unscrewed and a cable can be connected to one or more processors 325 through one or more connectors 330, each of which is contained in the internal cavity of the untethered measurement device 300 to program the untethered measurement device 300 and to download downhole property data measured by the untethered measurement device 300. While the two hemispheres of the housing 305, 310 are unscrewed, a battery 335, which is also contained in the internal cavity of the untethered measurement device 300, may also be replaced or recharged.

According to at least one embodiment, the battery 335 may be wirelessly recharged using inductive coupling or near field magnetic resonance coupling through an antenna (not shown) placed inside or outside of the untethered measurement device 300. The antenna may be, for example, a coil, planar spiral antenna, or a helical antenna. The same antenna can be used to program the microcontrollers and transfer the stored data from the sensor to an interrogator wirelessly.

According to at least one embodiment, the internal cavity of the housing of the untethered measurement device 300 is substantially maintained at ambient pressure or less, even as the external pressure around the untethered measurement device 300 increases as the untethered measurement device 300 descends further downhole into the well or decreases as the untethered measurement device 300 ascends uphole through the well.

According to at least one embodiment, the two hemispheres of the housing 305, 310 and internal contents of the untethered measurement device 300 have a weight, such that an average density of the untethered measurement device 300 is less than an average density of the one or more downhole fluids in the well, which enables the untethered measurement device 300 to float in the one or more downhole fluids along the well.

According to at least one embodiment, the two hemispheres of the housing 305, 310 are made, for example, of a non-magnetic stainless steel material.

According to at least one embodiment, the housing 305, 310 of the untethered measurement device 500 is spherical in shape to provide strength to the untethered measurement device 300 and to facilitate accurate prediction of a drag on the untethered measurement device 300 as it moves along the well. In accordance with another embodiment, the housing 305, 310 is cylindrical in shape to provide strength to the untethered measurement device 300, for ease of manufacturing, and to increase the volume of the internal cavity of the untethered measurement device 300 for a given diameter. The diameter of the housing 305, 310 is less than the diameter of the casing, tubing, or hole in which it will operate.

According to at least one embodiment, the housing 305, 310 has a non-uniform distribution of density within it, such that the untethered measurement device 300 has a righting moment that maintains an orientation of the untethered measurement device 300 as it moves down and up in the well. According to at least one embodiment, the untethered measurement device 300 is configured to have a heavy end and a light end, such that the light end will be positioned up toward the top surface of the subterranean well and the heavy end positioned down toward the bottom of the subterranean well, as the untethered measurement device 300 moves in the well. In accordance with another embodiment, weight within the housing 305, 310 is distributed, so that the housing has no preferred orientation, allowing it unbiased movement in response to fluid motion along the well.

As further shown in FIG. 6, the untethered measurement device 300, according to at least one embodiment of the invention, includes a controller 340 for controlling a buoyancy of the untethered measurement device 300, and therefore controlling a movement of the untethered measurement device 300 along the subterranean well. According to at least one embodiment, in a well where one or more downhole fluids is stationary, descent of the untethered measurement device 300 is accomplished by the untethered measurement device 300 having an average density that is more than the average density of the one or more downhole fluids in the well (that is, having negative buoyancy), and ascent of the untethered measurement device 300 is accomplished by the untethered measurement device 300 having an average density that is less than the average density of the one or more downhole fluids in the well (that is, having positive buoyancy).

According to at least one embodiment, in a well where the one or more downhole fluids are upward moving fluids (for example, during production when hydrocarbons are flowing from a subsurface hydrocarbon reservoir to the surface, or during drilling when drilling mud returns to the surface on the outside of a drill string), the untethered measurement device 300 has an average density that is greater than the average density of the one or more upward-flowing downhole fluids, in order for the untethered measurement device 300 to descend into the well against the flow of the one or more upward flowing downhole fluids. In this case, the change in direction of the untethered measurement device 300 from descending into the well to ascending up the well can be accomplished by changing the average density of the untethered measurement device 300 from being much more than that of the downhole fluids to be a little more than that of the downhole fluids, because of the additional drag force generated by the flow of the upward flowing downhole fluids.

According to at least one embodiment, in a well where the one or more downhole fluids are downward moving fluids (for example, within the drill string during drilling), the untethered measurement device 300 needs to have an average density that is less than or slightly greater than the average density of the one or more downward flowing downhole fluids, in order for the untethered measurement device 300 to descend into the well with the flow of the one or more downward flowing downhole fluids. In this case, the change in direction of the untethered measurement device 300 from descending into the well to ascending up the well can be accomplished by changing the average density of the untethered measurement device 300 to be much less than that of the downhole fluids to ascend against the force generated by the flow of the downward flowing downhole fluids.

According to at least one embodiment, in a well with multiphase flows (that is, a flow having at least two unmixed fluids, such as oil and water or oil, natural gas and water, or natural gas and water), the untethered measurement device 300 ascends up the well by making its average density less than or equal to at least one of the phases which is ascending the well in sufficiently large packages. For example, in a flow where alternating slugs of water and gas move up the well, the untethered measurement device 300 ascends up the well by having an average density that is less dense than the water phase, such that the untethered measurement device 500 ascends in a water slug.

According to at least one embodiment, the controller 340 includes a weight 345, for example, an iron weight. In one embodiment, the weight 345 is made of a water dissolvable polymer, such that the weight 345 does not remain permanently within the well. The weight 345 is removably secured to an exterior surface, for example, a bottom exterior surface, of one of the two hemispheres of the housing 305, 310 of the untethered measurement device 300. In such an orientation, the weight of the weight 345 causes the untethered measurement device 300 to have a density greater than the one or more downhole fluids in the well, thereby causing the untethered measurement device 300 to descend into the one or more downhole fluids in the well. According to at least one embodiment, the controller 340 releases the weight 345 from the exterior surface of the one of the two hemispheres of the housing 305, 310 of the untethered measurement device 300, thereby causing the untethered measurement device 300 to ascend toward a top surface of the one or more downhole fluids in the well. Thus, the controller 340 is capable of controlling a buoyancy of the untethered measurement device 300.

As further shown in FIG. 6, the controller 340 of the untethered measurement device 300 further includes a weight securing means 350 for securing and releasing the weight 345 to and from the exterior surface of the one of the two hemispheres of the housing 305, 310 of the untethered measurement device 300. According to at least one embodiment, the weight securing means 350 includes, for example, a switching device 365. The switching device 365 includes, for example, a magnetic flux switching device. The switching device 365 may include one or more magnets 355, 360. The one or more magnets 355, 360 include a switchable permanent magnet or an electro-permanent magnet.

According to at least one embodiment, the switchable permanent magnet includes an actuator and a permanent magnet. The actuator rotates the permanent magnet, so that a flux path of the permanent magnet either links or does not link the weight 345 to the exterior surface of the housing 305, 310 of the untethered measurement device 300.

According to at least one embodiment, the switching device 365 is a flux switching device, which includes, for example, a coil of wire that is energized to switch the flux of a permanent magnet between two stable paths, to control the connection between the weight 345 and the exterior surface of the housing 305, 310 of the untethered measurement device 300.

According to at least one embodiment, the switching device 365, as shown in FIG. 6, includes two permanent magnets connected in parallel, where one of the permanent magnets 355 is made of a material, for example, samarium cobalt (SmCo), which has a higher coercivity or resistance to having its magnetization direction reversed, while the second magnet 360 is made of a material, for example, Alnico V, which has a lower coercivity or resistance to having its magnetization direction reversed, and therefore can have its polarization direction changed easily. According to at least one embodiment, the size and material of the two permanent magnets 355, 360 are selected so that they have essentially the same magnetic strength (that is, remnant magnetization). Furthermore, the coil of wire is wrapped around the lower coercivity magnet (that is, the second magnet 360 shown in the embodiment illustrated in FIG. 6) In another embodiment, the coil may be wrapped around both magnets 355, 360 since the higher coercivity magnet is chosen such that it will not be repolarized by the field produced by the coil and therefore it is unaffected by being included in that field. In another embodiment, there are an even number of magnets (2 or more) all of the same low coercivity material (such as Alnico V) and the same dimensions. The coil is wrapped around half of those magnets, such that only half of the magnets have polarization adjusted by the coil. The advantage of making all magnets of the same low coercivity material is that it simplifies the problem of matching the magnetic strength of the repolarized and unrepolarized magnets to ensure exact field cancellation in the polarization state which cancels the fields. Failure to exactly cancel the fields in the polarization state designed to cancel the fields could result in failure to release the weight.

When a short (for example, a 200 microsecond) pulse of a large electrical current (for example, 20 amps) is applied to the coil of wire in one direction, it permanently polarizes the lower coercivity magnet (that is, the second magnet 360 shown in the embodiment illustrated in FIG. 6) in the same direction as the higher coercivity magnet (that is, the first magnet 355 shown in the embodiment illustrated in FIG. 6), so that magnetic flux lines run through a flux channel 370 to the outside of the housing 305, 310, where they attract the weight 345 to the untethered measurement device 300. According to at least one embodiment, the flux channel 370 is made of a material, for example, iron, having a high magnetic permeability.

When an electrical current is applied to the coil of wire in the opposite direction, it permanently polarizes the low coercivity magnet 360, in the opposite direction from the high coercivity magnet 355, so that the magnetic flux travels in a loop through the two magnets 355, 360 and end pieces, but does not substantially extend outside those pieces, removing the force that held the weight 345 to the untethered measurement device 300 and allowing the weight 345 to drop free from the untethered measurement device 300. As a result, the untethered measurement device 300 ascends within the well.

One of ordinary skill in the relevant art will recognize that there are other means of holding and releasing the weight 345. For example, in other embodiments, the controller 340 of the untethered measurement device 300 may apply an electrical current to generate heat that melts through a coupling between the weight 345 and the housing 305, 310, applies an electrical current to energize a mechanical device, such as a solenoid to release the weight 345, or shuts off an electrical current to de-energize a mechanical device, such as a solenoid or an electromagnet that retains the weight 345, each causing the weight 345 to drop from the untethered measurement device 300.

One of ordinary skill in the relevant art will further recognize that dropping a weight is only one method for changing the buoyancy of the device and there are other methods by which the buoyancy of the device could be changed. For example, other methods of changing buoyancy include expelling liquid out of a compartment or a ballast tank, for example, by triggering a chemical reaction or using an electrochemical process to generate gas within the ballast tank to displace the liquid, or by pushing the liquid out using a mechanical plunger, or pumping it out using a pump. In another embodiment, buoyancy is changed by means of a piece of material which is attached to the device and which is caused to go through a phase change (for example, melting or freezing), such that the mass of the material remains the same, yet its volume changes. The material is situated in the device, so that a change it its volume causes a change in the total volume of the device, for example, in one embodiment the material is contained in a compliant container which is in contact with downhole fluids in the well (that is, not contained within an entirely rigid housing), such that when the phase change occurs and the material expands or contracts, the container also expands or contracts, and the overall volume of the device increases or decreases. Embodiments of the invention provide that there is a natural geothermal temperature gradient in wells, such that the temperature increases with depth. Thus, making part of the device, in accordance with an embodiment of the invention, from a material, which expands when melting and contracts when freezing makes the device become lighter near the bottom of the well (eventually causing it to ascend) and heavier at the top of the well (eventually causing it to descend). The phase change temperature of the material and the thermal conductivity between the outside environment and the material is selected to cause the device to travel back and forth between specified depths. In one embodiment, an electronic controller in the device applies additional heating or cooling to the material, for example through a Peltier junction, to further control when the phase change takes place and therefore when the buoyancy change takes place. In one embodiment, the phase changing material is paraffin wax (which typically has a melting point between 46 and 68 degrees C. and undergoes a volume increase of about 15% when melting.

According to at least one embodiment, the housing diameter and the device density before and after its buoyancy change are optimized to achieve the desired descent and ascent rates given the density, viscosity, velocity and flow regime of the one or more downhole fluids in the well and for the diameter of pipe, casing, or hole in which the untethered measurement device 300 will operate. One of ordinary skill in the relevant art will recognize that increasing the weight of the untethered measurement device 300 will tend to make it descend more quickly or rise less quickly. Similarly, increasing the diameter of the untethered measurement device 300 will tend to couple the untethered measurement device 300 more closely to the surrounding flow, such that the untethered measurement device 300 tends to move with the surrounding flow, rather than moving contrary to that flow in the well. This is especially true once the diameter of the untethered measurement device 300 is a substantial fraction, about 25% or more, of the pipe diameter.

Thus, the controlled movement of the untethered measurement device 300, according to various embodiments of the invention, is bi-directional, in that the untethered measurement device 300 travels down the well after the untethered measurement device 300 is deployed, and travels up the well, after the controller changes buoyancy or drag, such that the downhole fluids return the untethered measurement device 300 back to the top surface of the subterranean well. It will be understood that moving up or down the subterranean well refers to moving along the trajectory of the well toward the shallower or deeper (respectively) ends of that trajectory.

As further shown in FIG. 6, the untethered measurement device 300, according to at least one embodiment, includes one or more sensors for measuring downhole properties along the well, as the untethered measurement device 300 descends and ascends in the well. For example, the one or more sensors are configured to measure one or more physical, chemical, and structural properties of the well. The physical, chemical, and structural properties of the well include, but are not limited to, temperature, pressure, "water cut," which is an amount of water or brine present in downhole fluids, volume fractions of brine and of hydrocarbons in the downhole fluids, flow rate of oil, water, and gas phases, inflow rate of the oil, water, and gas into the well from surrounding rock formations, the chemical composition of the brine mixture, the chemical composition of hydrocarbons, the physical properties of the hydrocarbons, including, for example, density or viscosity, the multiphase flow regime, the amount of corrosion or scale on the casing or production tubing, the rates of corrosion or scale buildup, the presence or absence of corrosion inhibitor or scale inhibitor that might be added to the well, the open cross-section within the production tubing or borehole which would conventionally be measured by calipers, the acoustical or elastic properties of the surrounding rock, which may be isotropic or anisotropic, the electrical properties of the surrounding rock, including, for example, the surrounding rock's resistive or dielectric properties, which may be isotropic or anisotropic, the density of the surrounding rock, the presence or absence of fractures in the surrounding rock and the abundance, orientation, and aperture of these fractures, the total porosity or types of porosity in the surrounding rock and the abundance of each pore type, the mineral composition of the surrounding rock, the size of grains or distribution of grain sizes and shapes in the surrounding rock, the size of pores or distribution of pore sizes and shapes in the surrounding rock, the absolute permeability of the surrounding rock, the relative permeability of the surrounding rock, the wetting properties of fluids in the surrounding rock, and the surface tension of fluid interfaces in the surrounding rock.

According to at least one embodiment, the one or more sensors includes a position sensor 375 configured to measure the location of the untethered measurement device 300 along the well. In one embodiment, the position sensor 375 is a pressure sensor, which measures the pressure acting on the untethered measurement device 300 for determining the depth at which the untethered measurement device 300 is positioned along the well or within the one or more downhole fluids in the well, where a relationship between pressure and depth is determined from one of theoretical calculations, laboratory experiments, and field tests.

In accordance with another embodiment, the one or more sensors includes a position sensor 375 configured to calculate an amount of time that the untethered measurement device 300 has been descending down into the well, where a relationship between time and depth is determined from one of theoretical calculations, laboratory experiments, and field tests.

In accordance with another embodiment, the position sensor 375 is a casing or tubing collar detector configured to detect when the untethered measurement device 300 passes a casing or tubing collar in the well and continues to count the number of casing or tubing collars, which have been passed in the well to determine the depth of the untethered measurement device 300 in the well. In particular, the presence of a casing or tubing collar is detected based on an additional pipe thickness at the casing or tubing collar or is detected based on the gap between pipe joints at the casing or tubing collar or is detected based on the larger diameter of the pipe joints at the casing or tubing collar, determined, for example, by inductive, electromagnetic, or acoustic means, and where the depth of the untethered measurement device 300 is calculated based on the number of casing or tubing collars passed and optionally interpolated between casing or tubing collars based on at least one selected from the group consisting of time, pressure, and accelerometer data, since the last casing or tubing collar was passed. In accordance with at least one embodiment, the casing collar or tubing collar detector transducer is the one or more transducers described below for converting a physical property of interest into a measurable electrical signal.

In accordance with another embodiment, absolute reference points from casing or tubing joint ends or collar detections are combined with inertial navigation data or accelerometer data to interpolate the position of the untethered measurement device 300 within pipe joints or between collars. The collars connect individual pipe or casing joints (that is, pipe sections) together. Their locations are well known from the well design or can be accurately surveyed by a collar detecting wireline tool. Position along the well can also be determined from measured hydrostatic pressure. This method of determining location is less accurate than the combination of collar detection with inertial navigation, especially if the density profile (that is, density vs. depth) of the one or more downhole fluids in the well is uncertain, however it is simpler to implement and can operate where there are no collars present, such as in an open (uncased) hole. According to at least one embodiment, position along the well is also determined by the elapsed time the untethered measurement device 300 has been moving based on the predicted velocity of the untethered measurement device 300. This is the least accurate method of determining position along the well due to uncertainty in the untethered measurement device 300 velocity. Position estimation, or the determination of position in the well, is aided by mapping the depth of detectable landmarks and providing the device 300 with a detector configured to detect these landmarks.

For example, beacons or RFID tags are placed at known locations in the well to aid in position determination. In another example, features of convenience are used, such as changes in tubing diameters or properties of the surrounding rock formations. In accordance with an embodiment, the untethered measurement device 300 integrates multiple sources of position information to provide maximal accuracy in position estimation and to minimize the risk of mission failure.

According to at least one embodiment, velocity of the untethered measurement device 300 is determined using acoustic Doppler backscatter from the wall of the well or pipe containing the untethered measurement device 300. Device velocity relative to the downhole fluids is determined by comparing the relative velocity between the untethered measurement device 300 and the downhole fluids in front vs. behind the untethered measurement device 300, as determined by acoustic Doppler backscatter measurements in both directions. Device velocity relative to the well downhole fluids is also determined by ultrasonic echolocation, measuring difference in acoustic time of flight between two ultrasonic transducers when the first transducer is a transmitter and the second transducer is a receiver versus when the first transducer is the receiver and the second transducer is the transmitter. Device velocity relative to the well downhole fluids is also calculated from the difference in acoustic travel time directly between two transducers versus along a second propagation path between the transducers, which also reflects from the inner surface of the borehole or pipe that contains the untethered measurement device 300. This calculation requires knowing the distance from each transducer to the inner surface, which is determined by measuring the acoustic round trip travel time from each sensor to the inner surface and back.

According to at least one embodiment, position of the untethered measurement device 300 in the horizontal direction (or perpendicular to the axis of the well) is determined by measuring the two-way travel time of an acoustic signal emitted by an array on the surface of the housing 305, 310 of the untethered measurement device 300 and reflected back to the untethered measurement device 300 by the inner surface of the pipe, tubing, casing, or borehole that contains the untethered measurement device 300. Alternatively, inductive coils near the outside surface of the untethered measurement device 300 measure distance to the inside wall of a metal pipe based on the losses they sense from eddy currents induced in the pipe. Accelerations of the untethered measurement device 300 and position changes over short time period are calculated from accelerometers or an inertial navigation system mounted in the untethered measurement device 300. However such measurements are subject to drift, so that other methods must be relied upon for position information that is stable over the long term According to at least one embodiment, the untethered measurement device 300 changes buoyancy or drag, initiating the return to the surface, when a certain condition on a certain measured quantity is attained. The measured quantity may be, for example, but is not limited to, (1) time, where the buoyancy or drag change is triggered when the current time or elapsed time equals or exceeds a specified time, (2) pressure, where the buoyancy or drag change is triggered when the pressure equals or exceeds a specified pressure, (3) depth, where the buoyancy or drag change is triggered when the depth equals or exceeds a specified depth, (4) temperature, where the buoyancy or drag change is triggered when the temperature equals or exceeds a specified temperature, (5) fluid characteristics, where the buoyancy or drag change is triggered when fluid characteristics outside the sensor are measured to be within ranges corresponding to a fluid of interest, such as measuring the dielectric properties or conductivity of the fluid outside the untethered measurement device 300 and changing buoyancy or drag when those properties are within such a range as to indicate that the fluid outside the untethered measurement device 300 is, for example, gas condensate vapor, oil, brine, dry gas, a liquid, a vapor, or a gas.

According to at least one embodiment, the one or more sensors 375 includes a downhole property sensor configured to measure one or more downhole properties of the one or more downhole fluids in the well. The one or more downhole properties include, but are not limited to, density or viscosity of the one or more downhole fluids in the well. In one embodiment, the one or more sensors 375 includes a mechanical oscillator such as, but no limited to, a piezoelectric tuning fork, along with the necessary circuitry to actuate and sense its motion. This mechanical oscillator would directly probe the fluid through the interaction of its prongs, or mechanically active part, with the boundary layer of fluid around it. Through in-situ or laboratory calibration, the response of the motion, in time or frequency domain, of the untethered measurement device 300 can be directly correlated to physical properties of the fluid such as, but not limited to, the viscosity, density, compressibility, and dielectric constant.

According to at least one embodiment, the one or more sensors 375 includes an accelerometer configured to measure device accelerations. This acceleration data is then related to one of: a flow regime or a presence of inflow of one or more constituents (for example, oil, water, and gas) into the well. Flow regimes or inflow into the well will have a characteristic effect on the pattern of accelerations experienced by the untethered measurement device 300, and these patterns may be detected to determine flow regime and quantify inflow.

According to at least one embodiment, the one or more sensors 375 includes a chemical sensor configured to measure a chemical property of the one or more downhole fluids in the well.

According to at least one embodiment, the one or more sensors 375 each includes one or more transducers (not shown) that convert, for example, a physical property of interest into a measurable electrical signal. The physical property of interest includes, for example, but is not limited to, the density, viscosity, velocity, turbulence, flow regime, temperature, or chemical composition of the one or more downhole fluids in the well. The physical property of interest also includes, for example, but is not limited to, the degree of corrosion, scale buildup, distortion from round, hole diameter, pipe diameter, mudcake thickness, mudcake coverage, pipe coupling locations, or locations of the ends of pipe joints in the well or inside tubing or casing pipes within the well. The physical property of interest also includes, for example, but is not limited to, the depth, location, or lateral location, velocities, or accelerations of the untethered measurement device 300 within the well. The physical properties of interest may include the condition, setting state, or integrity of cement within the well. The physical property of interest also includes, for example, but is not limited to, electrical, acoustical, mechanical, compositional, fluid content, density, or flow properties of the rock formations near the well. The physical property of interest may also include, for example, but is not limited to, the pressure at the untethered measurement device 300 or distance between untethered measurement devices 300. The physical property of interest may also include, for example, but is not limited to, the strength of an electromagnetic signal transmitted from a nearby untethered measurement device 300 or nearby fixed transmitter, such as a microwave or inductive signal, which is transmitted to ascertain properties of the surrounding fluid, well, or rock formations.

According to at least one embodiment, the physical property of interest includes, for example, but is not limited to, the diameter of the well, the cross-sectional area of the well, the roughness or distance from the untethered measurement device 300 to a rock face, pipe surface, tubing surface, or casing surface within a well.

These physical properties could be determined by measuring acoustic travel time or the character of the acoustic signal emitted by an array on the surface of a ball and reflected back to a sensor by the inner surface of the pipe, tubing, casing, or borehole that contains the sensor. Measurements of these physical properties would be valuable, for example, in determining an amount of scale buildup in a well to decide whether to apply an anti-scaling treatment, whether to clean the well, or whether to replace a pipe, tubing, or other mechanical component within the well. In another example, these measurements are useful in determining an amount of corrosion in a well to decide whether to apply corrosion inhibitors or whether to replace pipe or tubing within the well. Such measurements are also useful to predict when pipe or tubing or other mechanical components within the well need to be replaced due to scale or corrosion. In another example these measurements are useful in measuring the size of the borehole to determine an amount of cement required to cement in the casing and assessing whether there are large vugs, pore spaces, karstic features, or washout zones, which will cause cement or drilling mud to be lost into the rock formations, assessing the stability of subterranean rock layers to decide whether a particular rock layer will require casing. Generally, in measuring dimensions within a well (that is, the dimensions of the borehole or of pipe, tubing, or casing within the well), the one or more sensors of the device 300, according to at least one embodiment, serves the same set of applications as a calipers log (or well dimensions log), but without the added cost of mobilizing a wireline crew and surface support vehicles and without the need to kill the well or use a blowout preventer (BOP) and lubricator system to operate in a producing well. In addition the one or more sensors of the untethered measurement device 300 pass through smaller constrictions within the well, such as valves, bypasses, pipe bends, and annuluses between pipes or between pipes and rock formations, where a wireline calipers tool may be unable to go.

In accordance with at least one embodiment, the physical property values include the acoustic or elastic properties of the interface between casing and cement or between cement and the rock formations around the well. These properties would typically be determined, using conventional tethered measurement devices, by emitting acoustic signals from the ball that would reflect from or travel along the interfaces between casing, cement, and or rock formations. According to various embodiments of the invention, the untethered measurement device 500 records the travel times, propagation paths, amplitudes, and phases of these signals for indicating the strength of the bond between the cement and the casing or rock formations, which is a critical property for ensuring pressure isolation between rock formations, well control, and the general safety of the well.

In accordance with at least one embodiment, the measured physical property values include, but are not limited to, the upward flow velocity within the well, the upward flow velocity or volume fractions of one or more of the fluids within the well, the inflow into the well from the rock face or from perforations or holes in a pipe or tubing or casing within the well, the density and/or viscosity of one or more fluids within the well or of a combination of fluids within the well. Flow velocity (both upward and into the well), the volume fractions of different fluids, and the physical properties (such as density and viscosity) of the fluids can be determined by measuring the time history of the location of the untethered measurement device 300 as it falls and rises within the well, or equivalently, measuring the path and velocity of the untethered measurement device 300 through the well.

In accordance with at least one embodiment, the velocity of the untethered measurement device 300 along the well is related to the density difference between the untethered measurement device 300 and the one or more downhole fluids, the viscosity of the one or more downhole fluids, and the vertical flow velocity in the well, according to theoretical calculations and laboratory studies familiar to persons skilled in the relevant art. According to at least one embodiment, this relationship can be utilized to determine the viscosity, flow velocity, and density of the one or more downhole fluids in the well from the velocity of the untethered measurement device 300 moving through the well, especially when the velocity is measured with the one or more sensors 375 of the untethered measurement device 300 at two different densities (that is, before and after the change of buoyancy). To better constrain the calculation of density, viscosity, and flow velocity, a plurality of untethered measurement devices 300 of different densities is deployed into the well. When the density of an untethered measurement device 300 is matched to that of a particular fluid phase in a multiphase flow, the untethered measurement device 300 will tend to remain with that fluid phase, providing information about the dynamics of that particular phase within the flow. Once measured, the untethered measurement device 300 velocity may be used in inferring the density difference between the untethered measurement device 300 and the surrounding downhole fluid, the viscosity of the downhole fluid, the velocity of the downhole fluid phase that best matches the density of the untethered measurement device 300 or the velocity, density, and viscosity of the emulsion of the one or more downhole fluids that contains the untethered measurement device 300. Applications for measuring the flow velocity, viscosity, and density include, for example, but are not limited to, optimizing bottom hole pressures and artificial lift systems in the well to maximize the recovery of oil or gas to the surface or to optimize the ability to prevent unwanted water or brine from entering wells. Knowing flow density is also a good indication of water cut or water holdup, which is the percent of water among the produced downhole fluids in the well. Mapping water cut vs. distance along the well can reveal where water is entering the well, guiding efforts to stop and reverse water breakthrough.

Measurement of the flow velocity variation with depth makes it possible to calculate the amount of inflow into the well as a function of depth. As the untethered measurement device 300 passes a port where inflow is occurring, its path will be deviated away from the port. Thus, tracking the horizontal position of the untethered measurement device 300 within the well as a function of depth also provides a measure of inflow. Applications for measuring inflow into wells include deciding on the depth at which to place horizontal wells or the depths at which to complete vertical wells for optimal recovery of hydrocarbons, verifying that perforations or hydraulic fracturing jobs have been successful and deciding whether to rework, measuring response of the earth to certain hydraulic fracturing designs to determine the optimal parameters for future fracturing, and improving reservoir models by providing real inflow data to compare with model predictions.

According to at least one embodiment, the accelerations of the untethered measurement device 300 (as measured by accelerometers or inertial navigation systems), also indicate the flow regime and amount of turbulence in the flow. Knowing the flow regime and amount of turbulence in the well as a function of position along the well aid in adjusting artificial lift parameters and pressure draw down to optimize production and maximize the life of downhole systems.

As further shown in FIG. 6, the untethered measurement device 300, according to at least one embodiment, further includes the one or more processors 325, which controls the operation of the untethered measurement device 300, the battery 335, which powers the untethered measurement device 300 and the electrical components contained therein, and the one or more connectors 330 used to program the untethered measurement device 300 and to download downhole property data measured by the untethered measurement device 300, when the two hemispheres of the housing 305, 310 are unsecured from one another and the housing is opened up.

According to at least one embodiment, the one or more processors 325 includes a non-transitory computer readable memory medium (not shown) having one or more computer programs stored therein operable by the one or more processors 325 to control the operation of the untethered measurement device 300 and to store the downhole property measured by the one or more sensors 375 of the untethered measurement device 300. The one or more computer programs can include a set of instructions that, when executed by the one or more processors 325, cause the one or more processors 325 to perform a series of operations for controlling the descent of the untethered measurement device 300 down into the well, measuring the downhole properties of the well as the untethered measurement device 300 descends down into the well, controlling the release of the weight 345 from the exterior surface of the one of the two hemispheres of the housing 305, 310 of the untethered measurement device 300, and measuring the downhole properties of the well as the untethered measurement device 300 ascends up the well to the top surface of the subterranean well. The measurements stored in the non-transitory computer readable memory medium is extracted when the untethered measurement device 300 returns to the top surface of the subterranean well, and the untethered measurement device 300 is opened up, such that an external computer can be connected to the one or more connectors 330.

According to at least one embodiment, a measurement plan is programmed into the processor 325, where the measurement plan includes the types and locations of measurements, which the one or more sensors 375 will make. In one embodiment, this measurement plan is programmed into the processor 325, before the untethered measurement device 300 is deployed. According to at least one embodiment, the untethered measurement device 300, once deployed, does not change the measurement plan based on the data values collected or based on any communication after deployment, while according to another embodiment, the measurement plan of the untethered measurement device 300 changes, in real-time, in response to the data values collected or based on a communication after deployment.

According to at least one embodiment, the one or more connectors 330 is a wired connection, for example, a serial or USB connector. According to at least one other embodiment, the one or more processors 325 further includes a transmitter 580 to wirelessly connect the one or more processors 325 to an external computer or device for receiving operational instructions for the untethered measurement device 300 and for downloading downhole property data measured by the untethered measurement device 300. In one embodiment, the wireless transmitter 380 is configured as one of a Bluetooth or Xbee radio module that enables a radio-frequency wireless transfer of data and operational parameters. In one embodiment, the wireless transmitter 380 includes an LED and a photodetector or phototransistor that enables optical communication, or a coil of wire that enables inductive communication. According to various embodiments of the invention, wireless communication between the untethered measurement device 300 and an external computer is preferred over a wired communication connection.

According to at least one embodiment, one of ordinary skill in the relevant art will recognize that various types of memory, for example, in the form of an integrated circuit having a data storage capacity, are readable by a computer, such as the memory described herein in reference to the one or more processors of the various embodiments of the disclosure. Examples of computer-readable media can include, but are not limited to: nonvolatile, hard-coded type media, such as read only memories (ROMs), or erasable, electrically programmable read only memories such as EEPROMs or flash memory; recordable type media, such as flash drives, memory sticks, and other newer types of memories; and transmission type media such as digital and analog communication links. For example, such media can include operating instructions, as well as instructions related to the apparatus and the method steps described above and can operate on a computer. It will be understood by one of ordinary skill in the relevant art that such media can be at other locations instead of, or in addition to, the locations described to store computer program products, for example, including software thereon. It will be understood by one of ordinary skill in the relevant art that various software modules or electronic components described above can be implemented and maintained by electronic hardware, software, or a combination of the two, and that such embodiments are contemplated by embodiments of the disclosure.

Other example embodiments of the untethered measurement device are disclosed in U.S. Pub. No. 2016/0320769 A1, which is incorporated by reference in its entirety.

Further modifications and alternative embodiments of various aspects of the disclosure will be apparent to those skilled in the art in view of this description. Accordingly, this description is to be construed as illustrative only and is for the purpose of teaching those skilled in the art the general manner of carrying out the embodiments described in the disclosure. It is to be understood that the forms shown and described in the disclosure are to be taken as examples of embodiments. Elements and materials may be substituted for those illustrated and described in the disclosure, parts and processes may be reversed or omitted, and certain features may be utilized independently, all as would be apparent to one skilled in the art after having the benefit of this description. Changes may be made in the elements described in the disclosure without departing from the spirit and scope of the disclosure as described in the following claims. Headings used described in the disclosure are for organizational purposes only and are not meant to be used to limit the scope of the description.

What is claimed is:

1. A method for retrieving an untethered measurement device used in a subterranean well ascending from a wellbore into a Christmas tree valve, the method comprising the steps of:

opening a swab valve of the Christmas tree valve;

deploying an expandable meshed component into the Christmas tree valve through a swab conduit, wherein the expandable meshed component has a substantially cylindrical geometry, wherein the expandable meshed component is in a compressed configuration, wherein the expandable meshed component in the compressed configuration has a diameter less than an inner diameter of the swab conduit;

allowing the expandable meshed component to transition from the compressed configuration to an expanded configuration at a target height in the Christmas tree valve such that the expandable meshed component in the expanded configuration is in contact with interior walls of both the swab conduit and a main conduit, wherein the expandable meshed component is positioned before an entrance of a production wing conduit;

opening a production wing valve of the Christmas tree valve such that production fluids enter the production wing conduit while the untethered measurement device is guided by the expandable meshed component in the expanded configuration, enters the swab conduit, and passes the swab valve;

closing the swab valve; and retrieving the untethered measurement device from the Christmas tree valve through the swab conduit.

2. The method of claim 1, wherein the expandable meshed component comprises a swellable material selected from the group consisting of: a polyacrylamide, a polyacrylate, a polysaccharide, starch, clay, an alkaline earth oxide, a superabsorber, and combinations of the same.

3. The method of claim 2, in the allowing step, the swellable material contacts a water-based fluidic component such that the expandable meshed component transitions from the compressed configuration to the expanded configuration.

4. The method of claim 1, wherein the expandable meshed component comprises a swellable material selected from the group consisting of: ethylene-propylene-copolymer rubber, ethylene-propylene-diene terpolymer rubber, butyl rubber, halogenated butyl rubber, styrene butadiene rubber, ethylene propylene diene monomer rubber, natural rubber, ethylene vinyl acetate rubber, hydrogenized acrylonitrile-butadiene rubber, acrylonitrile butadiene rubber, isoprene rubber, chloroprene rubber, polynorbornene, and combinations of the same.

5. The method of claim 4, in the allowing step, the swellable material contacts an oil-based fluidic component such that the expandable meshed component transitions from the compressed configuration to the expanded configuration.

6. The method of claim 1, wherein the expandable meshed component comprises a meshed sheet having a meshed structure capable of shrinking in a lateral direction allowing the substantially cylindrical geometry of the expandable meshed component to shrink in a radial direction.

7. A method for measuring properties along a subterranean well, the method comprising the steps of:

opening a swab valve of a Christmas tree valve;

descending an untethered measurement device into the subterranean well via the Christmas tree valve;

deploying an expandable meshed component into the Christmas tree valve through a swab conduit, wherein the expandable meshed component has a substantially cylindrical geometry, wherein the expandable meshed component is in a compressed configuration, wherein the expandable meshed component in the compressed configuration has a diameter less than an inner diameter of the swab conduit;

allowing the expandable meshed component to transition from the compressed configuration to an expanded configuration at a target height in the Christmas tree valve such that the expandable meshed component in the expanded configuration is in contact with interior walls of both the swab conduit and a main conduit, wherein the expandable meshed component is positioned before an entrance of a production wing conduit;

taking measurements using the untethered measurement device of one selected from the group consisting of: physical properties in the subterranean well, chemical properties in the subterranean well, structural properties in the subterranean well, dynamics of the untethered measurement device, position of the untethered measurement device, and combinations of the same;

opening a production wing valve of the Christmas tree valve such that production fluids enter the production wing conduit while the untethered measurement device is guided by the expandable meshed component in the expanded configuration, enters the swab conduit, and passes the swab valve;

closing the swab valve; and retrieving the untethered measurement device from the Christmas tree valve through the swab conduit.

8. The method of claim 7, wherein the untethered measurement device comprises a sensor configured to measure the data along the subterranean well as the untethered measurement device descends and ascends within the subterranean well.

9. The method of claim 8, wherein the sensor comprises a position sensor configured to calculate an amount of time that the untethered measurement device has been descending down into the subterranean well to determine a location at which the untethered measurement device is positioned along the subterranean well.

10. The method of claim 8, wherein the sensor comprises a position sensor including a casing or tubing collar detector configured to detect when the untethered measurement device passes a casing or tubing collar along the subterranean well and counts a number of the casing or tubing collars, which have been passed in the subterranean well, to determine a location at which the untethered measurement device is positioned along the subterranean well.

11. The method of claim 8, wherein the sensor comprises a downhole property sensor configured to measure one or more downhole properties of the one or more downhole fluids in the subterranean well.

12. The method of claim 8, wherein the sensor comprises a position sensor including a detector configured to sense a gap between casing or tubing joints when the untethered measurement device passes the gap along the subterranean well and further configured to count a number of the gaps which have been passed in the subterranean well, to determine a location at which the untethered measurement device is positioned along the subterranean well.

13. The method of claim 8, wherein the untethered measurement device comprises a processor configured to control the sensor measuring the data and to store the data, wherein the processor comprises instructions defining measurement parameters for the sensor of the untethered measurement device within the subterranean well.

14. The method of claim 13, wherein the untethered measurement device comprises a non-transitory computer-readable medium in communication with the processor having computer-readable instructions stored therein.

15. The method of claim 7, wherein the untethered measurement device comprises a transmitter configured to transmit the data to a receiver arranged external to the subterranean well.

16. The method of claim 7, wherein the expandable meshed component comprises a swellable material selected from the group consisting of: a polyacrylamide, a polyacrylate, a polysaccharide, starch, clay, an alkaline earth oxide, a superabsorber, and combinations of the same.

17. The method of claim 7, wherein the expandable meshed component comprises a swellable material selected from the group consisting of: ethylene-propylene-copolymer rubber, ethylene-propylene-diene terpolymer rubber, butyl rubber, halogenated butyl rubber, styrene butadiene rubber, ethylene propylene diene monomer rubber, natural rubber, ethylene vinyl acetate rubber, hydrogenized acrylonitrile-butadiene rubber, acrylonitrile butadiene rubber, isoprene rubber, chloroprene rubber, polynorbornene, and combinations of the same.

18. The method of claim 7, wherein the expandable meshed component comprises a meshed sheet having a meshed structure capable of shrinking in a lateral direction allowing the substantially cylindrical geometry of the expandable meshed component to shrink in a radial direction.

* * * * *